United States Patent [19]

Lamb et al.

[11] 3,957,384

[45] May 18, 1976

[54] SCREED EXTENSIONS FOR PAVING MACHINES

[75] Inventors: Ronald B. Lamb, Anaheim; David H. Williamson, Santa Ana, both of Calif.

[73] Assignee: Bower Industries, Inc., Orange, Calif.

[22] Filed: Nov. 12, 1974

[21] Appl. No.: 523,029

[52] U.S. Cl. ..... 404/118

[51] Int. Cl.[2] ..... E01C 19/22

[58] Field of Search ..... 404/118, 104, 119, 120, 404/101, 110

[56] References Cited

UNITED STATES PATENTS

| | | | |
|---|---|---|---|
| 2,953,977 | 9/1960 | Warren | 404/110 |
| 3,130,654 | 4/1964 | Apel | 404/104 |
| 3,335,646 | 8/1967 | Crayton | 404/110 |
| 3,373,669 | 3/1968 | Schmitz | 404/110 |
| 3,557,672 | 1/1971 | Schurtz | 404/118 |
| 3,572,227 | 3/1971 | Poulsen | 404/118 |
| 3,680,451 | 8/1972 | Birtchet | 404/104 |

*Primary Examiner*—Nile C. Byers
*Attorney, Agent, or Firm*—Edward D. O'Brian

[57] ABSTRACT

It is known to utilize a screed extension apparatus along the front surface of a mold board in a machine for spreading pulverulent material such as a paving machine. Such a screed extension apparatus normally includes a strike-off plate and means for mounting and moving this plate between a retracted position generally in front of the mold board and an extended position in which the strike-off plate extends from an end of the mold board so as to serve as an extension of the mold board. Such a structure can be improved by utilizing two housings, the second of which fits around the first in such a manner that the second housing may be moved linearly with respect to the first but is restrained from any other type of relative movement with respect to the first housing. The first housing is secured in front of the front surface of the mold board well above the bottom of the mold board and adjacent to the end of the mold board. The second housing carries the strike-off plate. Preferably a hydraulic cylinder is located in the first housing and is operatively connected to the second for use in moving the second housing relative to the first housing.

2 Claims, 5 Drawing Figures

SCREED EXTENSIONS FOR PAVING MACHINES

CROSS REFERENCE TO RELATED PATENTS

Poulson U.S. Pat. No. 3,572,227 issued Mar. 23, 1971.

BACKGROUND OF THE INVENTION

The invention set forth in this specification pertains to new and improved screed extensions of use with machines for spreading pulverulent material such as machines utilized in spreading an asphalt-rock composition utilized in creating so-called "blacktop" pavement.

For many years it has been common to construct paving machines as are indicated in the preceding paragraph utilizing a mold board at the back of an area where pulverulent material is distributed. As a machine as indicated moves in a forward direction the mold board acts to smooth and level off this pulverulent material. Occasionally it is necessary and/or desirable to use a paving machine to distribute and level off such material beyond an end of a mold board. As a consequence of the recognition of this need so-called "screed extensions" have been developed for use with paving machines as described.

Such screed extensions have normally utilized a strike-off plate mounted in front of the mold board adjacent to the end of the mold board in a manner permitting such a plate to be moved either outwardly from or inwardly toward the mold board as desired as a machine for spreading pulverulent material of the type indicated is used. While certain prior screed extension devices of the type indicated are considered to be quite utilitarian and desirable it is considered that there is a need for screed extensions devices in which a hydraulic mechanism for moving a strike-off plate is located in such a location that the heat of any pulverulent material processed will not affect the operation of the hydraulic mechanism. Further, it is considered that there is a need for screed extensions having a smaller cross-sectional dimension than prior screed extensions so as to avoid any possibility of the extension interfering with the operation of the machine. It is also considered that there is a need for new and improved screed extension apparatus which may be easily and conveniently constructed at a comparatively nominal cost and which are capable of being utilized for prolonged periods with minimum amounts of maintenance.

SUMMARY OF THE INVENTION

A basic objective of the present invention is to provide new and improved screed extension apparatus which meet the needs for improvement indicated in the preceding discussion. Thus, the invention is intended to provide screed extension devices in combination with the mold boards the machines for spreading pulverulent pulverent material which can be constructed at comparatively nominal cost and which are capable of being utilized for prolonged periods with minimum maintenance. The invention is also intended to provide screed extension apparatus having a comparatively small cross-sectional thickness and having a hydraulic mechanism located where the heat of pulverulent material spread out and distributed by the mold board will not affect the operation of the hydraulic mechanism. The invention is also intended to provide screed extension apparatus which can be utilized for sloping in such a manner as not to take away pulverulent material from in front of the mold board of a spreading machine as indicated.

It will be apparent from the foregoing that the present invention is concerned with the known combination of a screed extension apparatus and a machine for spreading pulverulent material, the machine having an elongated mold board, this board having a top, a bottom, ends and a front surface, the screed extension apparatus including a strike-off plate, means for mounting the strike-off plate on the front surface of the mold board so that the strike-off plate can be moved between a retracted position generally in front of the mold board and in an extended position in which the strike-off plate is located so that a part of it is in front of the front surface of the mold board and in which the remainder of it extends outwardly from an end of the mold board, this screed extension apparatus also including a means for removing the strike-off plate between these two positions.

The invention is primarily concerned with the improvement of this combination which comprises the means for mounting the strike-off plate including first and second housings both of which have a uniform cross-sectional configuration along their lengths, the second housing fitting around the first housing and engaging the first housing so as to prevent the housings from disengaging one another, the second housing being linearly movable with respect to the first housing, the first housing being secured to the front surface of the mold board above the bottom of the mold board and adjacent to an end of the mold board, the second housing secured to the strike-off plate so that the strike-off plate extends downward from the second housing to a lower edge adjacent to the bottom of the mold board.

BRIEF DESCRIPTION OF THE DRAWINGS

The aforegoing summary is primarily intended to set forth a generalized background which will facilitate an understanding of the features or concepts claimed in the appended claims. These features or concepts are employed as shown in the accompanying drawings in which:

From a careful consideration of these drawings and of the remainder of this specification it will be apparent that the features and concepts set forth in the claims and embodied within the illustrated screed extension apparatus can be utilized in various screed extension apparatus having a somewhat different appearance and/or constructed in a somewhat different manner through the use or exercise of routine engineering skill.

DETAILED DESCRIPTION

Figure 1:
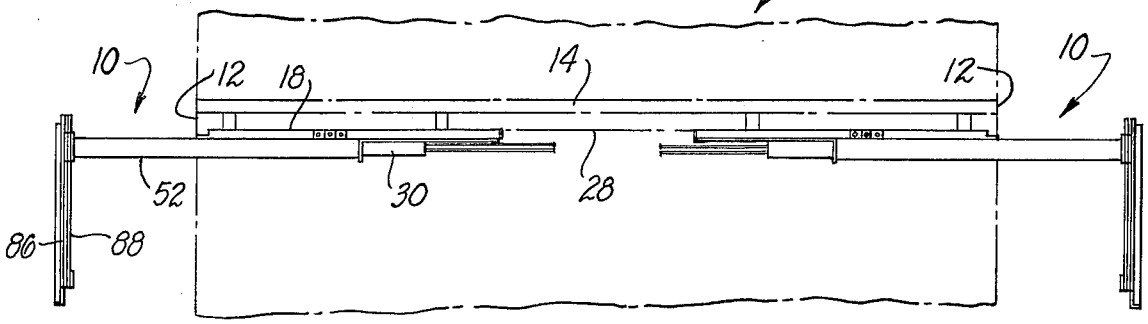
FIG. 1 is a top plan view illustrating two presently preferred screed extension apparatus installed at opposite ends of a mold board in a machine for spreading pulverulent material, this mold board and a part of this machine being illustrated in phantom in this and subsequent figures of the drawings.
Figure 2:
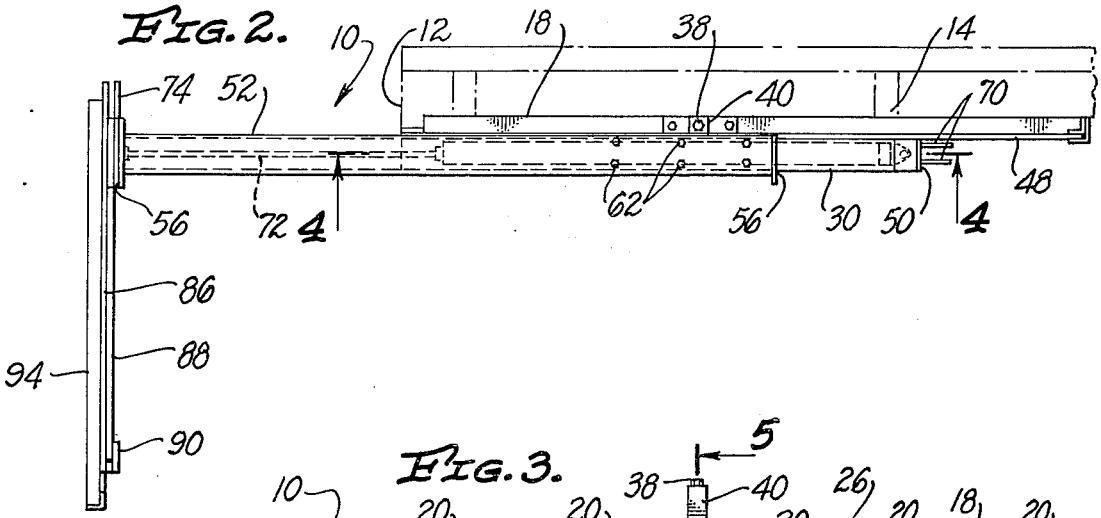
FIG. 2 is an enlarged top plan view of one of the screed extension apparatus units shown in FIG. 1.
Figure 3:
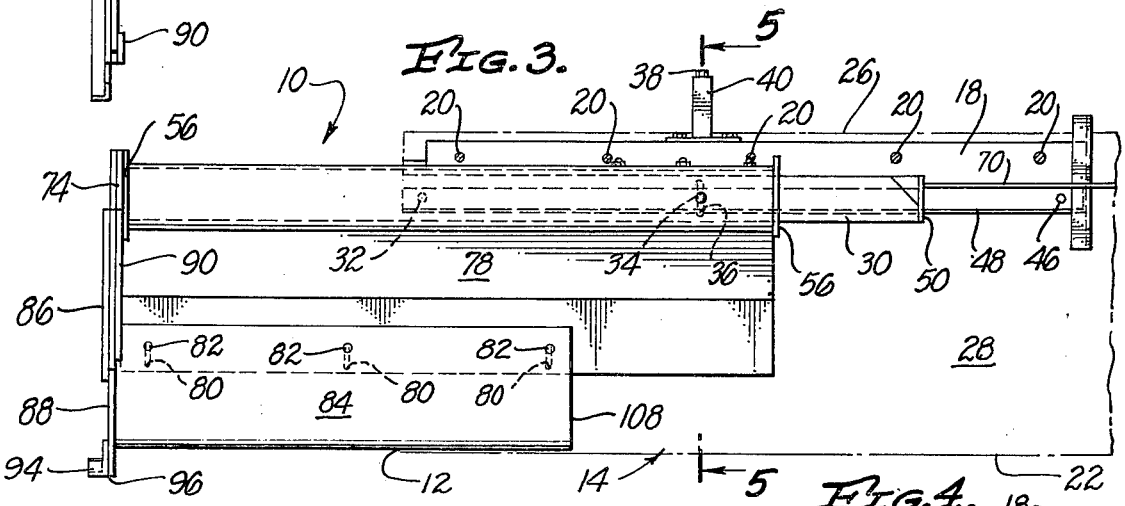
FIG. 3 is a front elevational view of the screed extension apparatus shown in FIG. 2.
Figure 4:
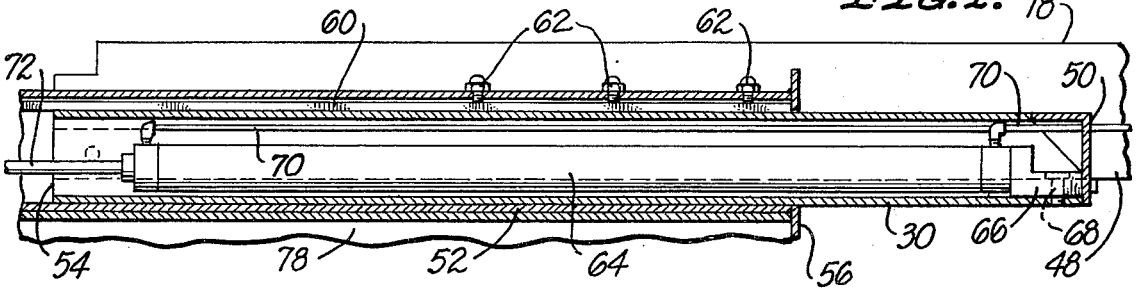
FIG. 4 is a partial cross-sectional view taken at line 2—2 of FIG. 2.
Figure 5:
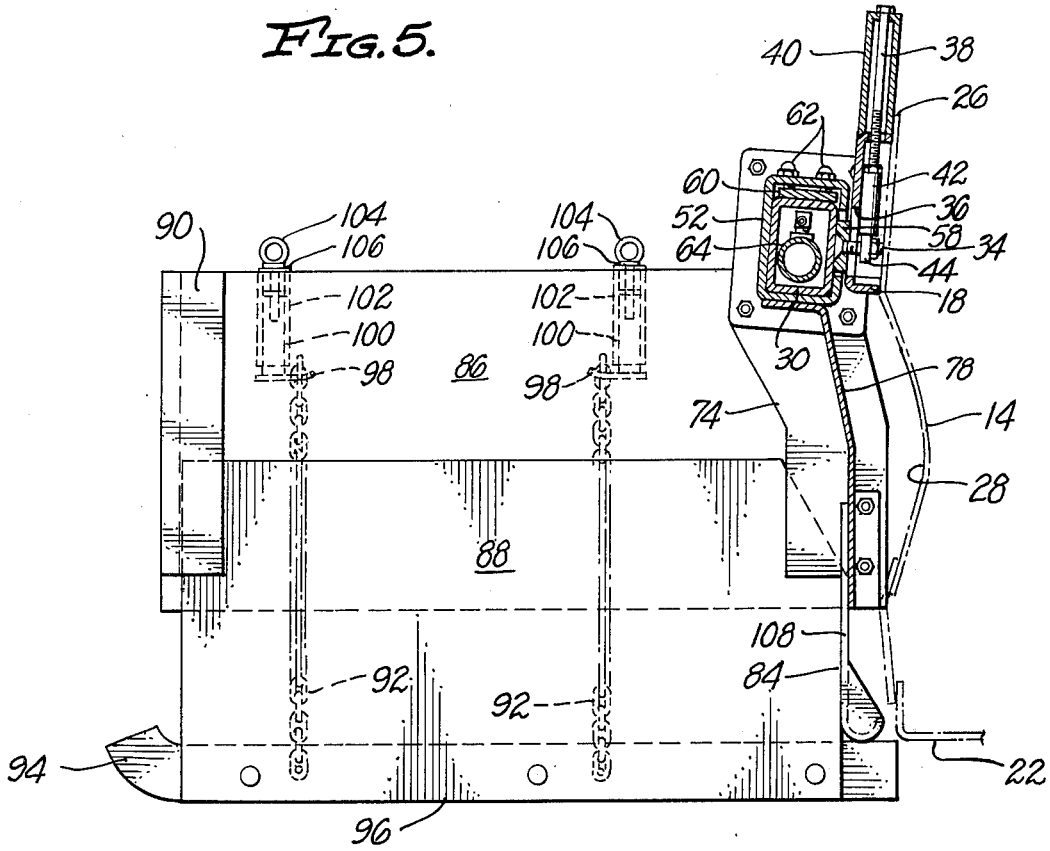
FIG. 5 is a cross-sectional view taken at line 5—5 of FIG. 3.

In the drawings there are shown two different screed extension apparatus 10 in accordance with this invention which are utilized at opposite ends 12 of a mold board 14 forming a part of a conventional machine 16 for spreading pulverulent material such as, for example, a machine for distributing and spreading out and leveling a hot asphalt-rock composition used to form so-called blacktop paving. The two apparatus 10 shown in FIG. 1 of the drawings are mirror images of one another. For this reason only the apparatus 10 appearing to the left of FIG. 1 of the drawings is illustrated in the subsequent figures of the drawings and is described herein.

The apparatus 10 utilizes an elongated mounting plate 18 which is secured by appropriate fasteners 20 to the mold board 14 so as to be parallel to the bottom 22 of this mold board 14 and so as to be located so as to extend inwardly from an end 12 of the mold board 14. Preferably this mounting plate 18 is secured to the mold board 14 adjacent to its top 26 so as to be in front of the front surface 28 of the mold board 14.

A first housing 30 is pivotally secured to the mounting plate 18 by means of a pivot type fastener 32. This first housing 30 has an elongated tubular shape and is of a uniform cross-sectional configuration throughout its length. It carries a small pin 34 which fits within an arcuate slot 36 in the mounting plate 18. This pin 34 and the slot 36 serve to limit rotation of the first housing 30 relative to the mounting plate 18 when it is desired to rotate this first housing 30 relative to the mounting plate 18. Such rotation can be accomplished through the adjustment of a bolt 38 extending through a bracket 40 on the mounting plate 18. This bolt 38 is threaded into an elongated nut-like sleeve 42 having a terminal ear 44 attached to the pin 34 in a conventional manner. During the normal use of the apparatus 10 the first housing 30 will be secured against rotation relative to the plate 18 through the use of a conventional bolt-type fastener 46 securing an extension 48 on an end 50 of the first housing 30 remote from the pivot 32 in place relative to the mounting plate 18.

A second housing 52 which also is of uniform cross-sectional configuration throughout its length is located as shown around the first housing 30. It will be noted that the housing 52 is of a "C" type shape and engages all surfaces of the housing 30 in such a manner that the second housing 52 cannot be removed from the first housing 30 except by being moved linearly either off of the end 50 or off of another end 54 of the housing 30 adjacent to the pivot 32. With this construction the various parts connecting the first housing 30 with the mounting plate 18 extend between ends 56 on the second housing 52 defining a slot (not shown). Preferably a small plate 58 is located on the first housing 30 so as to extend between these ends 56 and so as to fit up against the mounting plate 18. This provides spacing so that the proximity of the first housing 30 against the mounting plate 18 will not interfere with the linear movement of the second housing 52.

Preferably the first housing 30 also carries a bar 60 secured to this first housing 30. Wear and tension adjusting screws 62 are preferably mounted on the second housing 52 so that gravity will cause these screws 62 to bear against the bar 60. These screws 62 are preferably adjusted so that the second housing 52 fits closely relative to the first housing 30 in such a manner that there is very little "play" in a vertical plane as the second housing 52 is moved with respect to the first housing 30.

Such movement is caused through the actuation of a conventional hydraulic cylinder 64. This cylinder 64 is located within the first housing 30 so that a mounting lug 66 on it is secured by a conventional fastener 68 to the end 50 of the first housing 30. Conventional hydraulic lines 70 lead to the ends of the cylinder 64 in a conventional manner. These lines 70 pass from the first housing 30 through the end 50 to wherever a control panel (not shown) may be mounted on the machine 16. A piston rod 72 extending from the housing 30 is secured to an end plate 74 attached to an end 56 of the second housing 52.

An adapter plate 78 is secured by the second housing 52 along its length in such a manner that this plate 78 extends downwardly from beneath the second housing 52. This plate 78 is adapted to be spaced from but still to be closely positioned relative to the front surface 28 of the mold board 14. This plate 78 does not, however, extend to the bottom 22 of the mold board 14. It is provided with a plurality of vertically extending slots 80. Conventional fasteners 82 extend through a strike-off plate 84 through these slots 80 in such a manner as to mount the plate 84 on the plate 78.

With this construction the strike-off plate 84 may be adjusted as desired relative to the bottom 22 of the mold board 14. This strike-off plate 84 normally will not extend the full length of the adapter plate 78 but will only extend from the end plate 74 a sufficient distance so as to always overlap the end 12 of the mold board 14 during the operation of the apparatus 10.

The adapter plate 78 is preferably secured directly to the end plate 74 in a conventional manner. This end plate 74 carries a conventionally attached end gate or plate 86 which extends at a right angle to the adapter plate 78 and the strike-off plate 84. A so-called "floating" end gate or plate 88 is located so as to lie along the end plate 86 on the side of this end plate 86 closest adjacent to the middle of the machine 16. Normally the floating plate 88 will be positioned behind a front bent-over flange 90 on the end plate 86 and will slide up against the adapter plate 78 as its position is adjusted relative to the end plate 86.

Such adjustment is achieved by connecting chains 92 to a ski-type runner 94 secured in a conventional manner to the bottom 96 of the floating plate 88. These chains 92 are secured in a conventional manner to claw assemblies 98 located on internally threaded cylinders 100. These cylinders 100 are in turn located within tubes 102 mounted upon the end plate 86. Conventional threaded eye bolts 104 carrying washers 106 are threaded into the cylinders 100. Through rotation of these eye bolts 104 the elevation of the floating plates 88 may be adjusted as desired. Normally the runners 94 will be maintained at approximately the same level as the bottom 22 of the mold board 14.

It is believed that the operation of the apparatus 10 will be obvious to those familiar with the use of screed extensions. As the apparatus 10 is used the cylinder 64 will be actuated as desired so as to move the second housing 52 and all of the parts carried by it in a linear path either towards or away from the end 24 of the mold board 14. In all "normal" positions of the apparatus 10 the second housing 52 and the various parts carried by it will either be parallel to the mold board 14 or perpendicular to it.

When it is desired to slope pulverulent material beyond the end 24 of the mold board 14 the fastener 46 will be removed and the first housing 30 and all parts carried by it will be pivoted a limited amount relative to the mounting plate 18 and the mold board 14. When the cylinder 64 is actuated so as to space the second housing 52 as far from the mold board 14 as reasonably possible an edge 108 of the strike-off plate 84 will be nearly vertically aligned with the pivot 32.

The edge 108 will not, however, be exactly vertical and will extend beyond the end 24 of the mold board 14, but will approximately be even with this end 24 adjacent to the lowermost extremity of the edge 108.

As a consequence of this, the screed apparatus 10 will not take material from directly in front of the mold board 14 as the apparatus 10 is being used for sloping. This is considered to be quite important from a practical standpoint. This feature, however, is not the only advantageous feature of the appartus 10.

The apparatus 10 is considered quite desirable inasmuch as the hydraulic cylinder 64 in this apparatus is located within the first housing 30 at all times, and inasmuch as this cylinder 64 is also located within the second housing 52 a good part of the time. These housings 30 and 52 are located sufficiently high up on the mold board 14 so as to be spaced from the normally hot pulverulent material leveled and distributed through the use of the machine 16. In effect, the structure shown avoids the consequences of heat from pulverulent material affecting the hydraulic mechanism used by spacing the cylinder 64 as far from such material as reasonably possible, and by utilizing the housing 30 and at times the housing 52 as heat barriers or shields protecting the cylinder 64.

With the apparatus 10 the adapter plate 78 and the strike-off plate 84 extend downwardly from the second housing 52 so as to be located relatively close to the mold board 14. This is considered to be quite advantageous since, as a result of the construction, there is little tendency for the apparatus 10 to interfere with or to cause any interference with the operation of an auger (not shown) such as is normally employed in a paving machine.

We claim:

1. A screed extension apparatus in combination with a machine for spreading pulverulent material, said machine having an elongated mold board, said mold board having a top, a bottom, ends, and a front surface, said screed extension apparatus including a strike-off plate, means for mounting said strike-off plate on the front surface of said mold board so that said strike-off plate can be moved between a retracted position generally in front of said front surface of said mold board and an extended position in which said strike-off plate is located so that a part of it is in front of said front surface of said mold board and in which the remainder of it extends outwardly from an end of said mold board, said apparatus also including means for moving said strike-off plate between said retracted and said extended positions, in which the improvement comprises:

an elongated mounting plate secured to said mold board adjacent to the top of said mold board so as to extend inwardly from an end of said mold board in front of said mold board, a first housing having an elongated tubular shape and having a uniform cross-sectional configuration along its length pivotally mounted on said mold board adjacent to said end of said mold board and extending in front of said mounting plate, means for rotating said first housing a limited amount relative to said mounting plate, detachable means for securing said first housing to said mounting plate against rotation, a second housing of uniform cross-sectional configuration along its length and having a C shape fitting around and engaging said first housing so as to be capable of only linear movement with respect to said first housing, an adapter plate being attached to said second housing so as to extend downwardly therefrom generally in front of said mold board, said strike-off plate being attached to said adapter plate so as to extend downwardly therefrom to adjacent to the bottom of said mold board, said first and said second housing comprising said means for mounting said strike-off plate, a hydraulic cylinder including a piston rod extending therefrom located within said first housing so as to extend along the interior of said first housing, said cylinder being secured to the end of said first housing remote from said end of said mold board, said piston rod extending through the end of said first housing adjacent to said end of said mold board, said piston rod being connected to said second housing, said hydraulic cylinder and said piston rod comprising said means for moving said strike-off plate, said strike-off plate being shorter than said adapter plate, said cylinder being capable of being actuated so as to move said strike-off plate from a first position in which said strike-off plate is generally in front of said mold board and in which a corner of said strike-off plate is adjacent to and in front of a corner of said mold board at a lower edge of said mold board to another position in which the edge of said strike-off plate closest adjacent to the center of said mold board overlies said end of said mold board adjacent to said end of said mold board, said end of said strike-off plate being substantially vertically aligned with the pivotal connection of said mounting plate and said first housing when said strike-off plate is in said other position.

2. A screed extension apparatus as claimed in claim 1 including:

a wear plate secured to said first housing at the top of said first housing, a plurality of adjustment screws carried by said second housing and engaging said wear plate, said adjustment screws positioning said second housing on said first housing so that there is substantially no relative movement between said housings except in a linear direction.

* * * * *